US005348385A

United States Patent [19]

Berg

[11] Patent Number: 5,348,385

[45] Date of Patent: Sep. 20, 1994

[54] MODULAR WALL FURNITURE SYSTEM

[75] Inventor: Israel Berg, Raanan, Israel

[73] Assignee: Berg Jacob and Sons (Furniture), Ltd., Raanan, Israel

[21] Appl. No.: 918,545

[22] Filed: Jul. 22, 1992

[30] Foreign Application Priority Data

Sep. 16, 1991 [IL] Israel ..... 090502

[51] Int. Cl.[5] ..... A47F 5/08

[52] U.S. Cl. ..... 312/247; 248/243; 211/157; 108/108

[58] Field of Search ..... 312/245, 247, 242, 201, 312/107, 198; 248/243, 221.1, 225.1, 243; 108/108, 6; 211/187, 88

[56] References Cited

U.S. PATENT DOCUMENTS

| | | | |
|---|---|---|---|
| 1,983,470 | 12/1934 | Knape | 248/243 |
| 2,661,993 | 12/1953 | Little | 312/107 |
| 2,941,775 | 6/1960 | Armit | 248/243 |
| 2,956,766 | 10/1960 | Galassi | 248/243 |
| 3,043,642 | 7/1962 | Nelson | 312/198 |
| 3,606,024 | 9/1971 | Mieville | 211/187 |
| 3,828,937 | 8/1974 | Nash | 211/187 |
| 3,924,829 | 12/1975 | Boundy | 248/243 |
| 4,577,755 | 3/1986 | Ramsay | 211/88 |
| 5,002,248 | 3/1991 | Knape | 211/187 |
| 5,004,198 | 4/1991 | Tager | 248/225.1 |

FOREIGN PATENT DOCUMENTS

| | | | |
|---|---|---|---|
| 1073916 | 4/1952 | France | 211/187 |
| 603914 | 4/1960 | Italy | 211/187 |
| 627994 | 11/1961 | Italy | 211/187 |
| 955798 | 4/1964 | United Kingdom | 312/184 |

*Primary Examiner*—Flemming Saether
*Attorney, Agent, or Firm*—Robbins, Berliner & Carson

[57] ABSTRACT

A modular, wall-mounted shelf and furniture system which utilizes the combination of wood, plastic, and metal materials to provide space saving advantages and increased storage and functional utility by using multi-function support brackets.

11 Claims, 3 Drawing Sheets

MODULAR WALL FURNITURE SYSTEM

FIELD OF THE INVENTION

The present invention relates to room furniture and shelving systems, and more particularly, to a modular, wall-mounted shelf and furniture system which utilizes a combination of wood, plastic and metal materials designed to offer space-saving advantages while providing increased storage and functional utility by use of multi-function support brackets.

BACKGROUND OF THE INVENTION

The prior art of furniture and shelf systems includes a design commonly referred to as a "wall unit", which is typically a large cabinet constructed with shelves which are either exposed or enclosed behind glass doors. The shelves and cabinets are generally not readily interchangeable in location. The entire unit is either pre-assembled or is provided as a "knockdown" kit for user assembly. Heavy construction is common to most wall units.

An alternative to the "wall unit" design is a wall-mounted set of shelves supported from vertical posts or racks which are affixed to the wall. A set of support brackets are provided, and these are designed so that one end of each bracket engages the rack, the other end extending under the shelf. Other wall-mounted designs may include cabinets for interior storage of items, but support brackets are generally not used to support the cabinets. The shelves are a lightweight construction.

Therefore, it would be desirable to provide an easily assembled wall-mounted shelf and furniture system providing shelf and cabinet locations which are readily interchangeable, and which satisfied space-saving and storage requirements.

SUMMARY OF THE INVENTION

Accordingly, it is a principal object of the present invention to overcome the problems associated with prior art wall unit designs and provide a modular wall shelf furniture system in an attractive, space-saving design featuring increased storage and functional utility over conventional designs.

In accordance with the principles of the present invention, there is provided a modular wall furniture system comprising a furniture unit, at least a pair of vertically extending posts and at least one pair of opposing support brackets, each having a horizontal edge for supporting the furniture unit. The vertically extending posts each have a plurality of slots spaced vertically apart, the support brackets having vertical edges formed with clips to engage the slots, each of the support brackets having a planar surface extending above the horizontal edge, integrally formed with the horizontal edge and with the vertical edge. The furniture Unit is at least one of a shelf, a desk top and a storage cabinet.

In the preferred embodiment, the support brackets are formed with a planar surface contoured with the shape of a quadrant of a circle. The vertical bracket edge is formed with locking clips for insertion into the vertical support posts, and the horizontal edge is formed by a bent portion of the planar surface to provide support for an end of the shelf. Thus, each support bracket performs a multiple support function by simultaneously supporting the shelf and items placed on it.

The multi-function support brackets can also support storage cabinets provided as part of the inventive system. The horizontal bracket edges are designed to support each cabinet by its top side edges.

The inventive design utilizes a combination of materials, e.g. wooden shelves and cabinets, metal support brackets for load-bearing strength, and plastic moulding covering the vertical support posts. An attractive design is made possible by suitable color coordination.

A feature of the invention design is the provision of shelf accessories such as cloth pockets supported by rods extending between holes formed in the contoured edge of the brackets. These pockets are useful as magazine racks or for holding desk items. Alternatively, metal pockets may be provided. Metal or wooden work surfaces may also be attached to the shelves. In another alternative shelf accessory design, a rod extends between the bracket holes and supports a desk lamp.

Other features and advantages of the invention will become apparent from the drawings and the description contained hereinbelow.

BRIEF DESCRIPTION OF THE DRAWINGS

For a better understanding of the invention with regard to the embodiments thereof, reference is made to the accompanying drawings, in which like numerals designate corresponding elements throughout, and in which.

DETAILED DESCRIPTION OF A PREFERRED EMBODIMENT

Figure 1:
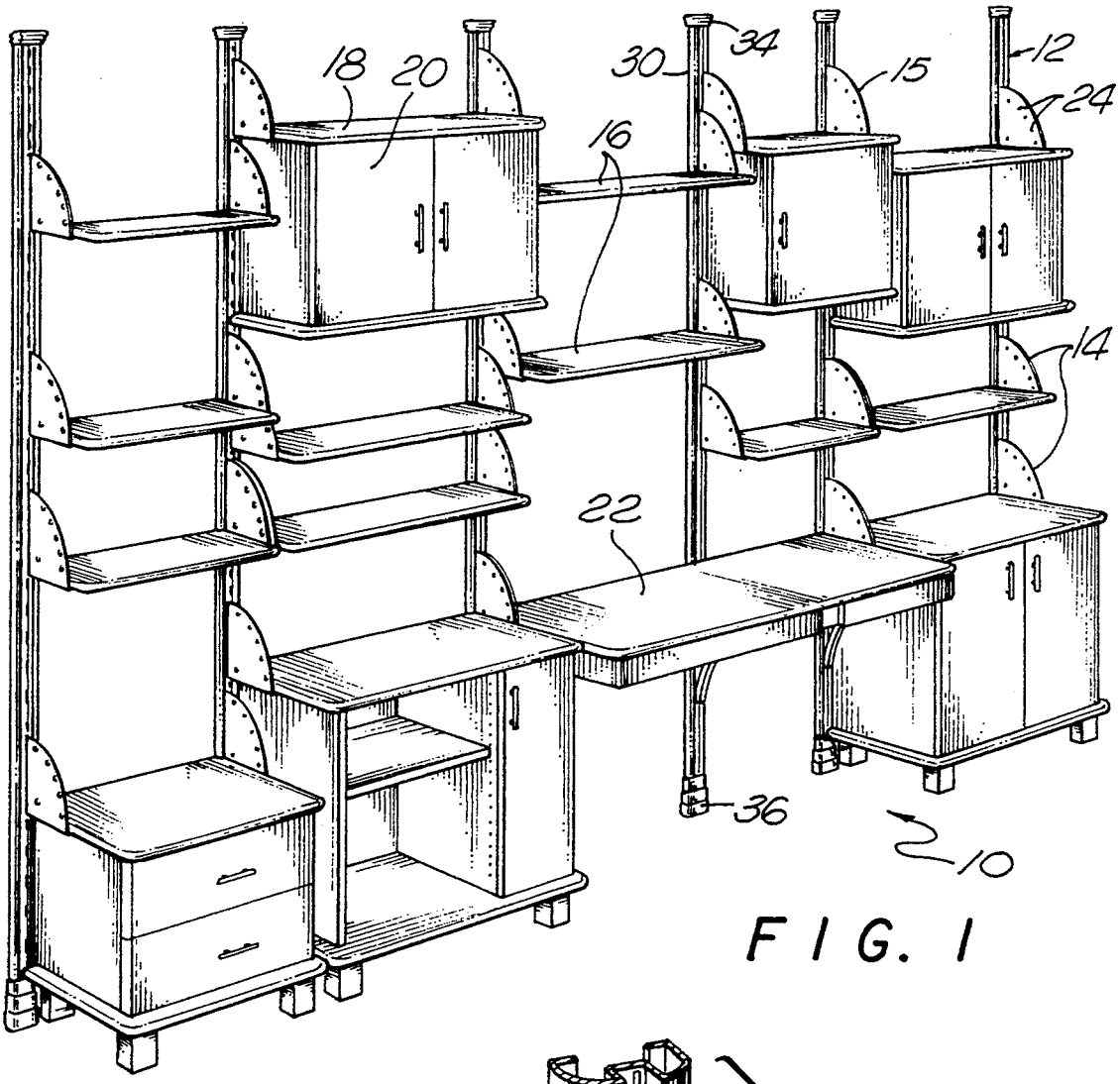
FIG. 1 is a perspective view of a preferred embodiment of a modular wall furniture system constructed in accordance with the principles of the present invention.

Referring now to FIG. 1, there is shown a perspective view of a modular wall furniture system 10 constructed in accordance with the principles of the present invention. As shown, system 10 comprises a plurality of vertical support posts 12, each of which is typically anchored in a room wall at various points along its length to provide adequate strength for support of the associated system loads. Vertical posts 12 provide support for a plurality of multi-function support brackets 14. Each pair of brackets 14 has a contoured edge 15 and is designed to provide support for a wall shelf 16, or a system furniture unit comprising the top side 18 of a cabinet 20 or a desk top 22.

As described further herein, support brackets 14 are designed to serve a triple function: 1) to provide support to shelves 16; 2) to serve as bookends supporting books and other items placed on shelves 16 and leaning against brackets 14; and 3) to support system furniture units such as cabinets 20 and table 22. In addition to these functions, an additional support function (see FIGS. 6–11) is provided by each of support brackets 14 through the set of holes 24 formed along its contoured edge 15.

Figure 2:
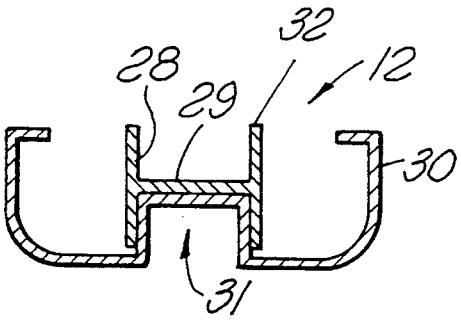
FIG. 2 is a cross-sectional view of a vertical support post and moulding for supporting the system shown in FIG. 1.

In FIG. 2, there is shown a cross-sectional view of vertical support post 12, illustrating its construction as an "H" structural column 28 and a decorative plastic moulding 30. Structural column 28 preferably has a reinforced middle section 29 for increased strength. Moulding 30 is shaped to fit within the recess 31 of structural column 28, where it is engaged by a mounting screw (not shown) which extends into the wall for anchoring the rear edges 32 of column 28 to the wall. The top and bottom ends 34—36 of moulding 30 (FIG. 1) may be provided with a decorative shape, such as a tier design.

Figure 3:
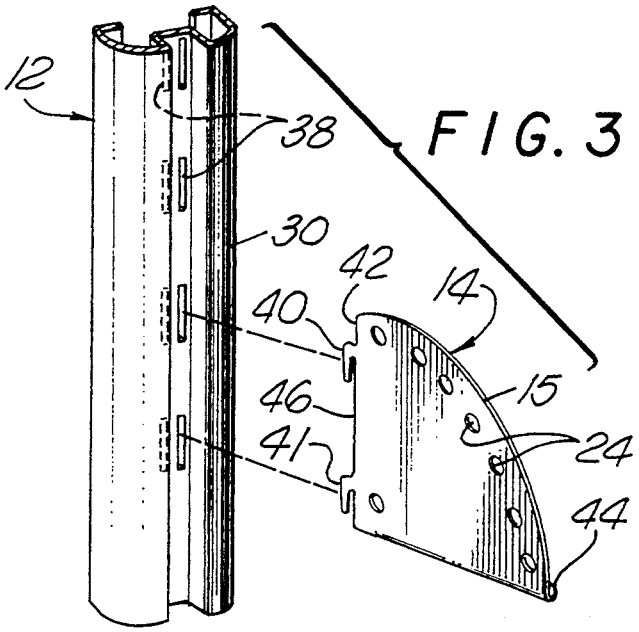
FIG. 3 is a perspective view showing a support bracket having a contoured edge, for assembly in the FIG. 2 support post.

In FIG. 3, there is shown a perspective view of support bracket 14 with contoured edge 15, for assembly in the support post 12 of FIG. 2. As shown, vertical support post 12 is formed with two rows of slots 38 spaced apart along its length. Each slot 38 is formed both in structural column 28 and in decorative moulding 30, and these are aligned so that slots 38 are usable.

A pair of hook-shaped clips 40 and 41 is formed in vertical edge 42 of each of support brackets 14, and these are designed to engage slots 38 for supporting brackets 14 from vertical support post 12. Clips 40, 41 are placed (along dotted lines) in slots 38 formed in one of the vertical rows and support bracket 14 is then depressed firmly into position. Another support bracket 14 may be anchored in position alongside the first, by placement in the adjacent vertical row of slots 38.

A horizontal edge 44 is formed in bracket 14 which serves to support shelf 16, the top side edges of cabinets 20, or desk top 22. Holes 46 (FIG. 4) formed in horizontal edge 44 are used to fasten shelves 16 or other system units to brackets 14.

Figure 4:
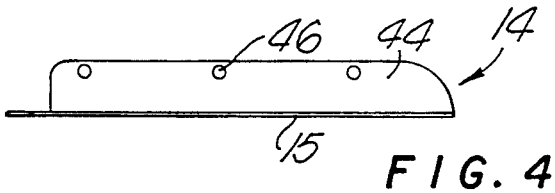
FIGS. 4–5 are, respectively, top edge and front views of the support bracket of FIG. 3.
Figure 5:
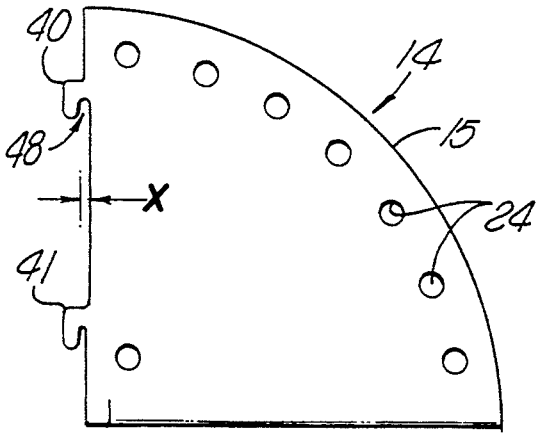

In FIGS. 4–5 there are shown, respectively, top edge and front views of the support bracket 14 of FIG. 3. A feature of the support bracket 14 inventive design is the provision of the recessed portion 46 formed in vertical edge 42 (dimension x) to provide clearance where needed for mounting screws holding the decorative moulding 30 to the wall.

Another feature of the support bracket 14 inventive design is provided by the shape of clips 40 and 41, to enable their easy insertion in the slots 38 of vertical support posts 12. Upper clip 40 is shaped with a notch 48 which is wider than that formed in lower clip 41, to provide support bracket 14 with additional freedom of lateral movement as lower clip 41 is inserted in slot 38. Once inserted, clips 40—41 are locked in position by depression in slot 38.

Figure 6:
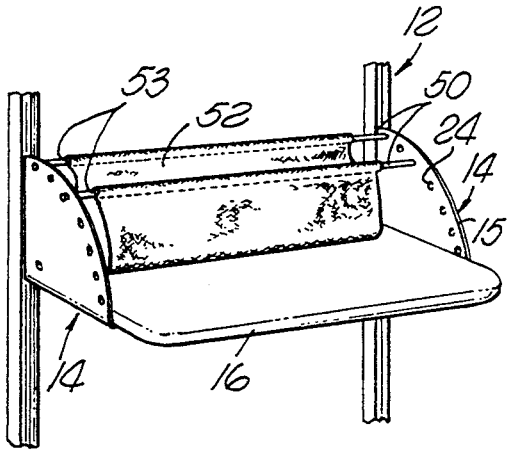
FIGS. 6–11 are perspective views showing alternative arrangements of shelf accessories usable with the system of FIG. 1.
Figure 7:
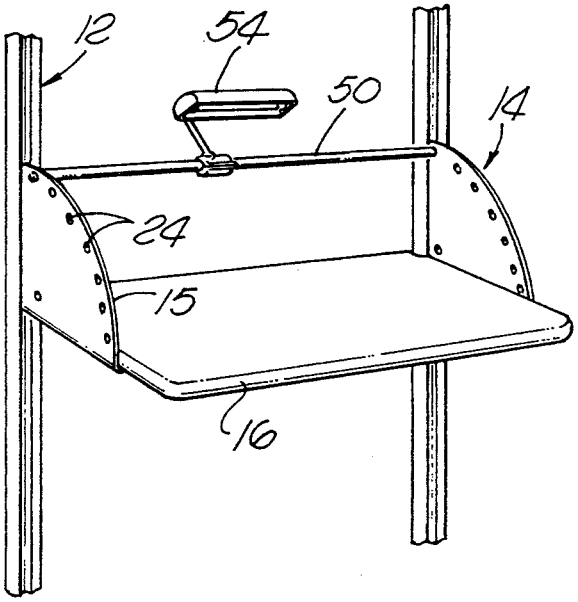

As shown in the alternative arrangements of FIGS. 6–11, support brackets 14 are designed to provide an additional support function, by use of the set of holes 24 formed in its contoured edge 15. In FIG. 6, a pair of rods 50 are provided which extend between opposing pairs of holes 24, and a cloth fabric 52 designed with sleeves 53 may be suspended between rods 50 to form a pocket for use in storing magazines, files or miscellaneous desk items. In FIG. 7, rod 50 extends between a pair of opposite holes 24 and supports a desk lamp 54.

Figure 8:
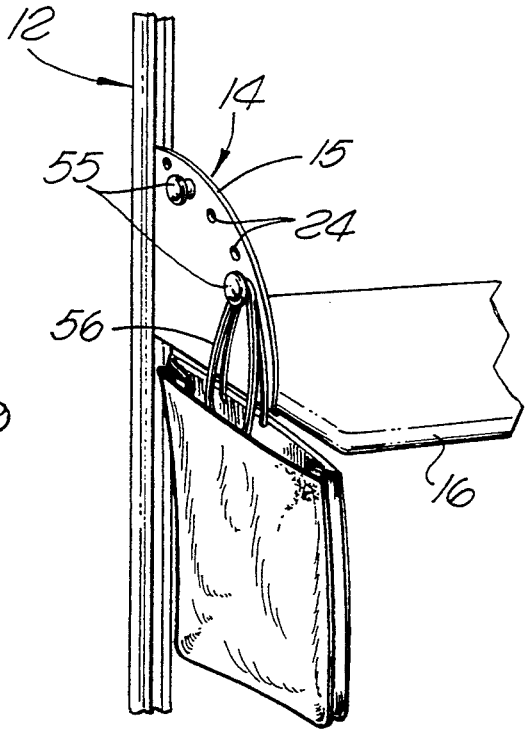
Figure 9:
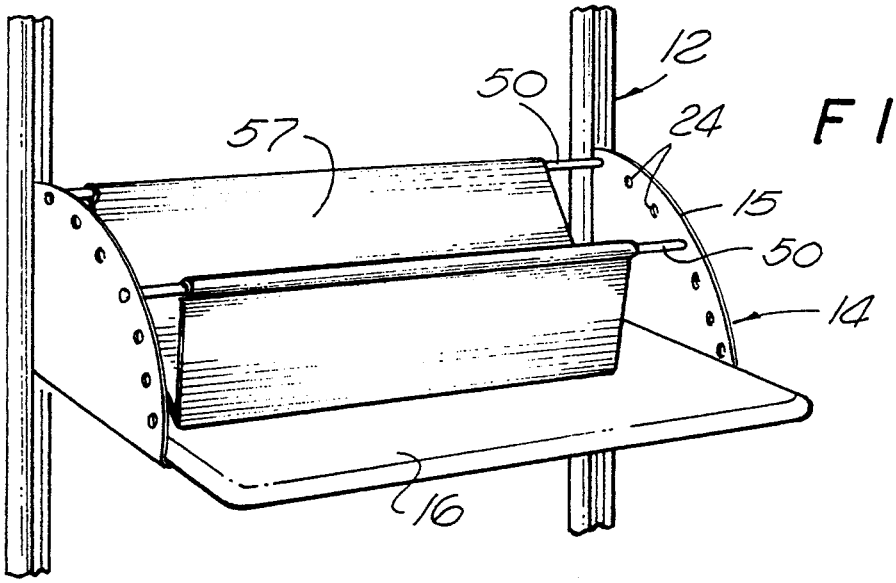

In FIG. 8, knobs 55 are placed in holes 243, providing a support from which to hang straps 56 of a shopping bag, purse, or briefcase. In FIG. 9, rods 50 and used to support a metal tray 57, shaped similar to the cloth fabric pocket of FIG. 6, for use as a magazine rack, desk organizer or file holder.

Figure 10:
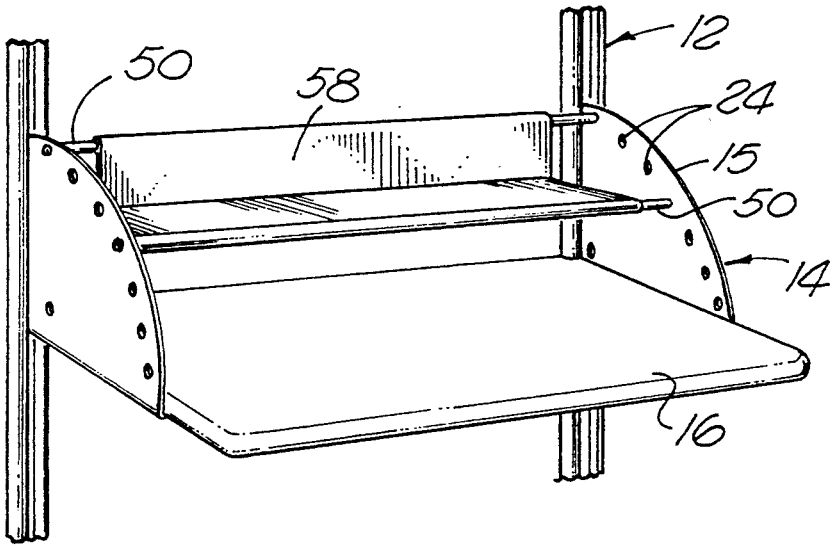
Figure 11:
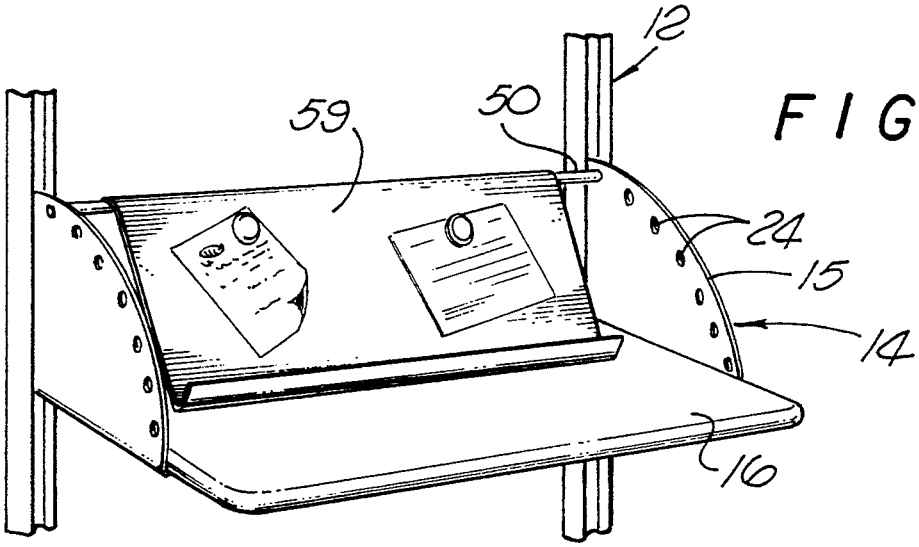

In FIG. 10, rods 50 are used to support a mini-shelf 58 made of rigid material, on which small items may be placed. In FIG. 11, another alternative arrangement is shown, with a work surface 59 made of rigid material supported at its top end by rod 50, and at its bottom end by shelf 16. Work surface 59 may be used for displaying various materials, and for manipulating them.

It will be appreciated that other alternative arrangements are possible for utilizing the support function provided by holes 24, and extending the usefulness of system 10.

In summary, the inventive modular wall furniture system 10 provides a space-saving design with maximum storage ability, by effective use of the multiple support functions of brackets 14.

Having described the invention with regard to certain specific embodiments thereof, it is to be understood that the description is not meant as a limitation since further modifications may not suggest themselves to those skilled in the art, and it is intended to cover such modifications as fall within the scope of the appended claims.

I claim:

1. A modular wall furniture system comprising:

a furniture unit comprising at least one of a shelf, a desktop and a storage cabinet;

at least a pair of vertically extending posts having formed therein a plurality of slots spaced apart vertically; and at least one pair of multi-function support brackets each having a vertical edge formed with at lest one clip to engage at least one of said slots, and a horizontal edge, a pair of opposing support brackets supporting said furniture unit at the ends thereof by said horizontal edges, said support brackets each having a planar surface defining an outer edge, said planar surface extending above said horizontal edge and being integrally formed therewith and with said vertical edge;

said planar surfaces of said opposing support brackets having holes formed therein along their outer edges, for supporting the ends of at least one rod extending between said edge holes on opposing brackets.

2. The furniture system of claim 1 wherein said support brackets are interchangeable in position on said vertically extending posts to arrange said furniture units as desired.

3. The furniture system of claim 1 wherein the outer edge of said planar surface of said support brackets is contoured as a quadrant of a circle.

4. The furniture system of claim 1 further comprising a desk lamp clamped to and supported by said rod.

5. The furniture system of claim 1 further comprising a cloth fabric having sleeves at its ends, suspended by said rods.

6. The furniture system of claim 1 further comprising a rigid surface having folded ends, suspended by said rods.

7. The furniture system of claim 1 further comprising a knob retained by one of said outer edge holes, for supporting a bag carrying strap.

8. The furniture system of claim 1 further comprising a mini-shelf of rigid materials, its ends supported by said rods.

9. The furniture system of claim 1 wherein said horizontal edges of said support brackets have holes formed therein, and ends of said furniture unit are attached to said horizontal edges via mounting hardware passing through said holes.

10. A modular wall furniture system comprising:

a furniture unit comprising at least one of a shelf, a desktop and a storage cabinet;

at least a pair of vertically extending posts having formed therein a plurality of slots spaced apart vertically; and at least one pair of multi-function support brackets each having a vertical edge formed with at least one clip to engage at least one of said slots, and a horizontal edge, a pair of opposing support brackets supporting said furniture unit at the ends thereof by said horizontal edges, said support brackets each having a planar surface extending above said horizontal edge and being integrally formed therewith and with said vertical edge;

said planar surfaces of said opposing support brackets providing end supports for items placed on said furniture unit;

wherein said vertical support posts each comprises vertically extending opposing members and a bridging member to form an H-shaped cross-section, defining a structural column and including a plastic molding form fitted to one side of said post so as to be in contact with said bridging member and those portions of said opposing members on said one side whereby to provide a decorative appearance, said plurality of slots each being formed through said molding and bridging member.

11. The furniture system of claim 11 wherein said vertical support posts are fabricated of aluminum covered on one side by plastic, said furniture unit is fabricated of wood materials, and said support brackets are fabricated of metal.

* * * * *